US005140926A

United States Patent [19]

Denston

[11] Patent Number: 5,140,926

[45] Date of Patent: Aug. 25, 1992

[54] SMALL BOAT THRUSTER KIT

[76] Inventor: Lawrence Denston, Rt. 1 Box 86, Brule, Wis. 54820

[21] Appl. No.: 726,215

[22] Filed: Jul. 5, 1991

[51] Int. Cl.[5] ..... B63H 25/46

[52] U.S. Cl. ..... 114/150; 440/6; 440/38

[58] Field of Search ..... 114/151; 440/6, 38, 440/68, 70; 60/221

[56] References Cited

U.S. PATENT DOCUMENTS

| | | | |
|---|---|---|---|
| 873,818 | 7/1907 | Wilke | 114/151 |
| 3,127,865 | 4/1964 | Pleugen | 114/151 |
| 3,143,972 | 8/1964 | Smith et al. | 440/6 |
| 3,400,682 | 9/1968 | Jones | 114/151 |
| 3,464,357 | 9/1969 | Duport et al. | 114/151 |
| 3,593,686 | 7/1971 | Cooper | 114/151 |
| 3,711,755 | 1/1973 | Meyer | 318/139 |
| 3,791,331 | 12/1974 | Dilley | 440/6 |
| 3,874,316 | 4/1975 | Lorenz | 114/151 |
| 3,903,829 | 9/1975 | Brix | 114/151 |
| 3,933,113 | 1/1976 | Dornak | 114/151 |
| 3,970,027 | 7/1976 | Jackson | 114/151 |
| 4,315,476 | 2/1982 | Van der Tak | 114/151 |
| 4,470,364 | 9/1984 | Ktauva et al. | 114/151 |
| 4,629,432 | 12/1986 | Dyrkorn et al. | 440/52 |

FOREIGN PATENT DOCUMENTS

| | | |
|---|---|---|
| 1109 | 1/1913 | United Kingdom . |
| 1419546 | 12/1975 | United Kingdom . |

*Primary Examiner*—Edwin L. Swinehart
*Attorney, Agent, or Firm*—Jacobson & Johnson

[57] ABSTRACT

A boat thruster kit that enables a boat owner to install a side thruster in a small boat with the aid of simple tools. The thruster uses a conventional reversible electric trolling motor that is housed in a pipe housing with offset flanged outlets connected to a pipe housing by expandable flexible pipes. Internal struts and supports holds the propulsion unit of the reversible electric trolling motor in a cross passage so that water can be directed out of either thrust port on the side of the watercraft.

8 Claims, 2 Drawing Sheets

SMALL BOAT THRUSTER KIT

FIELD OF THE INVENTION

This invention relates generally to side propulsion units for small water craft, and, more specifically, a low-cost boat thruster for installing a bow thruster in a small water craft.

BACKGROUND OF THE INVENTION

The concept of bow thrusters for steering boats in which thruster pumps are located at either the front or aft of a boat to provide lateral displacement of a boat is well known in the art. Typically, such bow thrusters are used with larger boats and ships to permit lateral movement of a boat into a dock. One of the problems with such prior art bow thrusters is that they are often very complicated and very expensive, thus making it impractical to install in smaller boats.

The present invention provides a low cost bow thruster kit that can be installed directly in the bow of a small water craft with the use of simple tools. Once installed the user can use the bow thruster to assist in the docking of the boat.

DESCRIPTION OF THE PRIOR ART

U.S. Pat. No. 873,818 shows a vessel with two sets of side thrusters which permit front and aft thrust of the vessel for ease in steering the vessel.

U.S. Pat. No. 3,127,865 shows a cylindrical cross conduit with two propellers located in the cross conduit for directing fluid and consequently thrust laterally of the watercraft.

U.S. Pat. No. 3,400,682 uses ballast pumps to provide a sideward force.

U.S. Pat. No. 3,593,686 shows a reversibly operated pump which has pivotal plates on each end with a central opening through the plates. When water is drawn in one side, the plate flips up and the water is forced out the other side in a high pressure jet through the smaller opening in the plate.

U.S. Pat. No. 3,711,755 shows the use of two electric motors on the side of a boat with a circuit to control the speed and the steering of the boat by controlling the speeds of the two motors.

U.S. Pat. No. 3,791,331 shows a battery-operated submersible electric outboard trolling motor.

U.S. Pat. No. 3,874,316 shows a bow thruster having a cross passage with pressure equalizing channels connected to the passage. A rotatable propeller is schematically shown in the middle of the cross passage.

U.S. Pat. No. 3,903,829 shows a lateral thruster control unit for water craft that has an open channel located parallel to the side thruster channel to permit circulation of water therethrough.

U.S. Pat. No. 3,933,113 shows a water jet propulsion unit which has a pivotable nozzle to direct fluid through a discharge port.

U.S. Pat. No. 4,315,476 shows a cross bow passage having a pivotal flap at the end to direct the fluid at an angle to the passage.

U.S. Pat. No. 4,470,364 shows a side thruster for a ship which reduces the vibration and noise.

U.S. Pat. No. 4,629,432 shows a propeller thruster which is elastically supported in the cross passage.

Whitaker Great Britain patent 1,109 shows a cross thruster with the ports located in a parallel but offset position.

Great Britain patent 1,419,546 shows a bow thruster unit which is located coaxially within a larger cross tube.

BRIEF SUMMARY OF THE INVENTION

Briefly, the invention comprises a boat thruster that enables a boat owner to install a side thruster in a small boat with the aid of simple tools. The thruster uses a conventional reversible electric trolling motor that is housed in a pipe housing with expandable flexible pipes connected to the pipe housing that holds the propulsion unit of the reversible electric trolling motor so that water can be directed out of either thrust port on the side of the watercraft by reversing the rotation of the propellor on the reversible electric trolling motor.

DESCRIPTION OF THE PREFERRED EMBODIMENT

Figure 2:
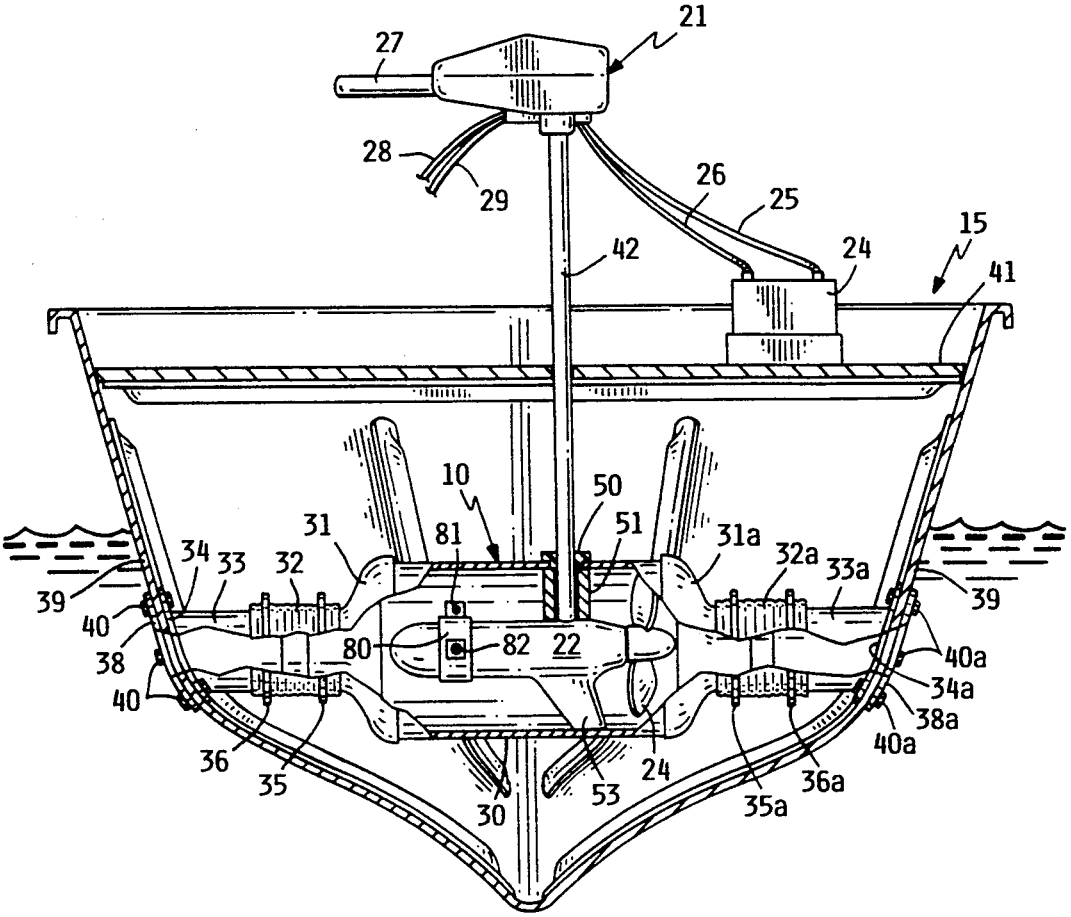
FIG. 2 shows a cross section of a view of my bow thruster kit mounted in the front of a boat.

FIG. 2 numeral 10 generally identifies my bow thruster mounted in the front or bow of a small boat 15 powered by an outboard motor. Bow thruster 10 comprises an electric trolling motor 21 which has a power propulsion unit 22 mounted within a cylindrical pipe or housing 30 that communicates with thrust ports on the opposite sides of boat 15. Electric trolling motor 21 is a conventional electric trolling motor used by fisherpeople to slowly propel their boats while fishing. Trolling motor 21 contains a power unit 22 with a reversible propeller 24 which can be rotated in either a clockwise or a counter clockwise direction. Thus the trolling motor can produce a first lateral thrust in a first direction coaxial with the propellor by rotating propellor 24 in a clockwise direction and a second thrust in a second direction opposite to the first direction by rotating the propellor in a counterclockwise direction.

A fin 53 supports propulsion unit 22 on the lower inside portion of pipe 30 and a clamp 80 extends around the housing of the propulsion unit 22 and is held in place by a screw 81. Extending horizontally outward from one side of clamp 80 is a first strut member 82 that engages one side of cylindrical pipe 30 and extending horizontally outward from the opposite side of clamp 80 is a second strut member (not shown) that engages the opposite side of cylindrical pipe 30 to hold propulsion unit 22 in axial alignment with cylindrical pipe 30. Located on topside of propulsion unit 22 is a collar spacer 51 that prevents propulsion unit 22 from moving upward in cylindrical pipe 30. A grommet like seal 50 forms a leakproof connection around shaft 50 of electric trolling motor 21 and cylindrical pipe 30 to prevent water from leaking into the boat.

The head of electric trolling motor 21 contains the controls for the electric trolling motor. An electric storage battery 24 powers trolling motor 21 through cables 25 and 26. A rotatable handle 27 permits the operator to control the speed and the direction of rotation of propellor 24. In certain trolling motors remote controls are available to permit remote control of the trolling motor. FIG. 2 shows portions of the remote control cables 28 and 29 for remotely controlling trolling motor 21.

Figure 1:
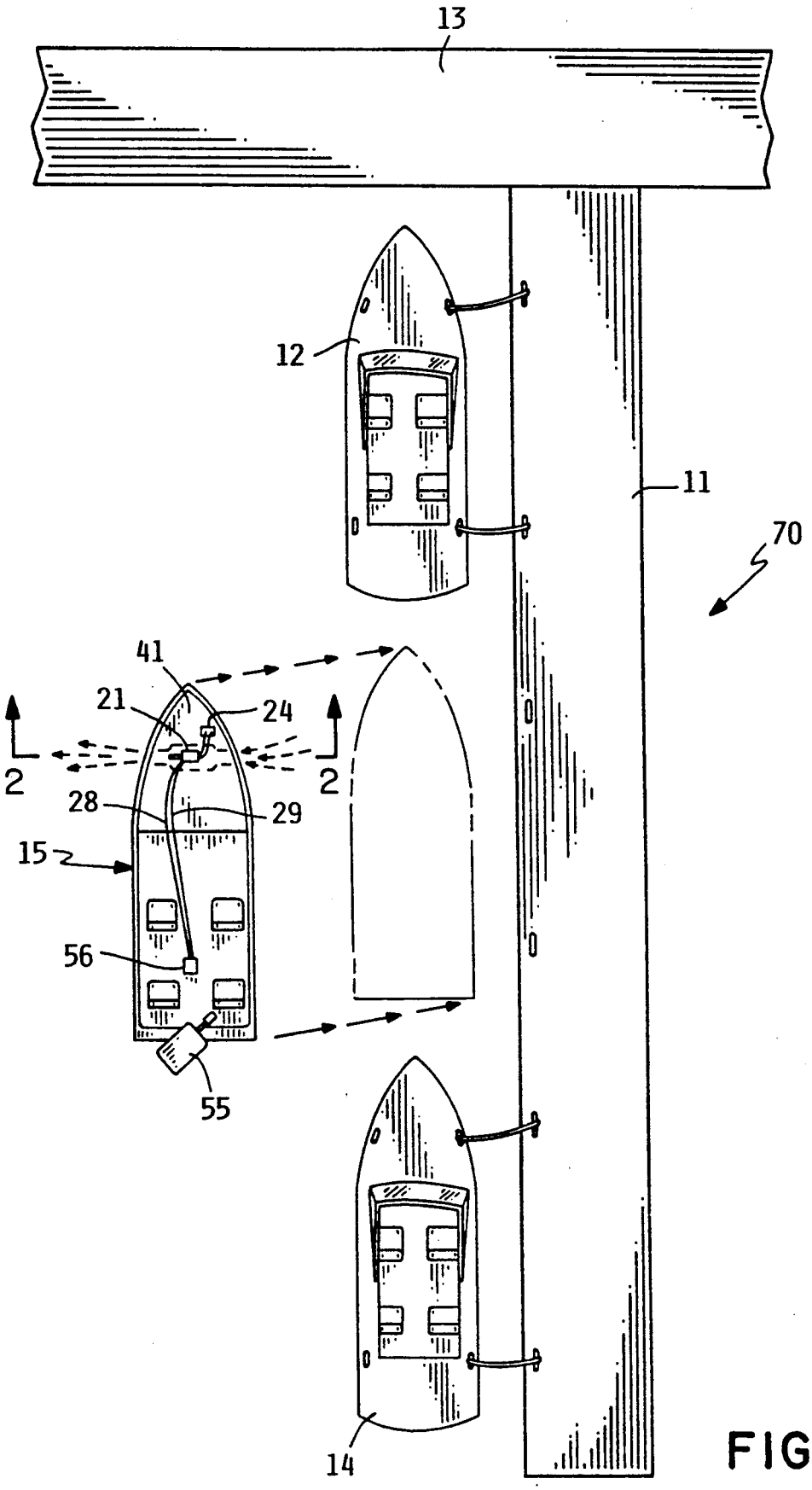
FIG. 1 shows an overhead view of a boat using my bow thruster to dock in a tight place.

FIG. 1 illustrates the remote control application in a small watercraft. That is, in some trolling motors remote controls are available so that cables 28 and 29 can be used to locate the controls of the trolling motor proximate the main power unit which may be an outboard motor 55. Although the trolling motor controls are remote from the bow the propulsion unit 22 remains fixed within cylindrical pipe 30 located in the bow of boat 15.

Referring to FIG. 2 the details of construction of my installed bow thruster kit can be seen in greater detail. Cylindrical pipe 30 comprises an enlarged section of pipe such as PVC pipe. Located in a leakproof relationship on end of pipe 30 is a reducing elbow 31. Reducing elbow 31 is secured to pipe 30 through a suitable solvent adhesive. Reducing elbow 31 connects to one end of an expandable, flexible pipe 32 by an airplane-clamp 35. The other end of expandable, flexible pipe 32 connects to one end of pipe 33 and is secured thereto by an airplane-clamp 36. The opposite end of pipe 33 contains a first offset flange 34 which has openings that mate with an outer flange 38 that is located in concentric alignment with pipe 33. A set of bolts 40 hold the flanges 38 and 34 in a sandwiching leakproof relationship on hull 39.

Similarly, located in a leakproof relationship on the opposite end of pipe 30 is a reducing elbow 31*a*. Reducing elbow 31*a* is secured to pipe 30 through a suitable solvent adhesive. Reducing elbow 31*a* connects to an expandable pipe 32*a* which is held on pipe 32*a* by an airplane-clamp 35*a*. The other end of expandable, flexible pipe 32*a* connects to one end of pipe 33*a* and is secured thereto by an airplane-clamp 36*a*. The opposite end of pipe 33*a* contains a first offset flange 34*a* which has openings that mate with an outer flange 38*a* that is located in concentric alignment with pipe 33*a*. A set of bolts 40*a* hold the flanges 38*a* and 34*a* in a sandwiching leakproof relationship on hull 39.

One of the features of my boat thruster is that the boat thruster can fit different size boats since the expandable tubing 32 and 32*a* permits one to mount the bow thruster unit in boats having different widths. Another feature is the offset flange permits rotating pipe 33 or 33*a* until they are in proper alignment so that the pipes 33 and 33*a* direct the water laterally and horizontally of the boat. Still another feature is that the flexibility of the pipes 32 and 32*a* allow for ease in mounting the bow thruster since one can lengthen or shorten the pipes to accommodate different width of boats. In addition the flexible pipes permit the bow thruster to flex as the boat is subjected to wave and water forces.

The combination of the grommet-like seal 51 and the flanges operate to prevent leakage of water into the interior of the boat. Thus my bow thruster unit is sealed and can be maintained below water line without allowing water into the boat.

In order for a user to install my bow thruster in a small water craft the user locates the water line of the empty boat and then measures down a distance that ensures that the side thrust ports will be below the water line. Next the user marks the outside of the hull using the flanges 38 and 38*a* as a pattern. After marking the user cuts openings in the side of the boat. When the openings are cut the user then can install pipe 33 with flange 34 on one side of the boat by rotating pipe 33 with the offset flange until pipe 33 is horizontal. Next one fastens flange 38 to flange 34 to secure and seal pipe 33 in the side of the boat. The flange 33*a* is then inserted and fastened in a similar manner. After securing the flanges the central pipe 30 housing the propulsion unit 22 can be connected to pipes 33 and 33*a* with the use of a screw driver.

FIG. 1 shows the operation of my bow thruster in better detail. Boat 15 is in the process of being docked next to a dock 70 comprising a first section 13 and a second section 11 having a boat 12 and a boat 14 moored thereto. Boat 15 which is about to be docked shows boat motor 55 on the rear of boat 15 with remote controls 56 for the electric trolling motor located in the bow thruster positioned next to the controls for rear motor 55. In thruster operation, the electric trolling motor 21 is turned on to allow water to be pumped through the bow to laterally direct the boat into the dock. By rotating the propellor 24 in one direction the thrust is directed laterally and horizontally to displace the boat in one direction and by rotating the propellor in the opposite direction thrust can be generated in the opposite direction. Consequently, the operator though the use of motor controls 55 and bow thruster 10 can quickly and easily direct boat 15 into the space between boats 12 and 14 which are tied to dock 11.

I claim:

1. A boat thruster for creating side thrust in a small watercraft comprising:

a central housing for encompassing the propulsion unit of an electric outboard trolling motor, said central housing having a central axis, a first end, and a second end;

a first reducing member connected to one end of said central housing, said first reducing member having a first large end and a second smaller end;

a first expandable flexible connector, said first expandable connector having a first end and a second end, said first end of said expandable flexible connector connected to said smaller end of said first reducing member;

a first outlet pipe, said first outlet pipe having a first end for securing to said second end of said first expandable flexible connector, said first outlet pipe having a second end with a first offset flange on said second end of said first outlet pipe to permit the user to rotate said first outlet pipe to orientate the first outlet pipe in a horizontal direction and said first offset flange parallel to the side of a boat to enable a user to secure said first offset flange to a first sidewall of the boat in a water proof manner;

a second reducing member connected to the other end of said central housing, said second reducing member having a first large end and a second smaller end;

a second expandable flexible connector, said second expandable flexible connector having a first end and a second end, said first end of said expandable flexible connector connected to said smaller end of said second reducing member;

a second outlet pipe, said second outlet pipe having a first end for securing to said second end of said second expandable flexible connector, said second outlet pipe having a second end having a second offset flange on said second end of said second outlet pipe to permit the user to rotate said second outlet pipe to orientate the second outlet pipe in a horizontal direction and said second offset flange on said second outlet pipe parallel to the side of the boat to enable a user to secure said second offset flange on said second outlet pipe to a second sidewall of the boat in a water proof manner; and a reversible electric trolling motor having a propulsion unit for directing thrust in opposite directions, said reversible electric trolling motor located in said central housing for directing thrust in lateral directions through said central housing to thereby permit a boat user to develop side thrust to assist the boat user in docking the boat.

2. The boat thruster of claim 1 wherein said reversible electric motor includes struts to maintain said propulsion unit coaxial with said central housing.

3. The boat thruster of claim 2 wherein said central housing comprises PVC pipe.

4. The boat thruster of claim 2 wherein said first outlet pipe and said second outlet pipe have openings of substantially the same size.

5. The boat thruster of claim 4 wherein said boat thruster includes a spacer to limit upward movement of said propulsion unit in said central housing.

6. The boat thruster of claim 5 wherein said reversible electric trolling motor includes remote controls to permit an operator to control the reversible electric trolling motor from the rear of the boat.

7. A boat thruster for creating side thrust in a small watercraft comprising:

a central housing for encompassing the propulsion unit of a reversible outboard trolling motor, said central housing having a chamber sufficiently large to support the propulsion unit and propellor of the reversible outboard trolling motor so as to permit the propellor to generate a thrust, said chamber having a first end and a second end;

a first connector connected to said first end of said chamber and to a sidewall of a boat;

a second connector connected to said second end of said chamber and to an opposite sidewall of the boat; and means for mounting the reversible outboard trolling motor in said central housing so that the reversible outboard trolling motor can direct thrust in either direction through said central housing, said means includes struts for holding the reversible outboard trolling motor in said central housing, said means includes a spacer and sealing member for forming a leakproof seal around a shaft of the reversible outboard trolling motor to prevent water from leaking out of said housing and into the boat to thereby permit a boat user to develop side thrust to assist the boat user in docking the boat.

8. The boat thruster of claim 7 including a reversible electric trolling motor that comprises the sole means of side thrust generation in either lateral direction of a vertical plane extending through the longitudinal axis of a boat.

* * * * *